US009464501B2

(12) United States Patent
Kristoffer

(10) Patent No.: US 9,464,501 B2
(45) Date of Patent: Oct. 11, 2016

(54) ZONAL ISOLATION UTILIZING CUP PACKERS

(71) Applicant: i-Tec AS

(72) Inventor: Braekke Kristoffer, Stavanger (NO)

(73) Assignee: Trican Completion Solutions AS, Stavanger (NO)

( * ) Notice: Subject to any disclaimer, the term of this patent is extended or adjusted under 35 U.S.C. 154(b) by 604 days.

(21) Appl. No.: 13/869,539

(22) Filed: Apr. 24, 2013

(65) Prior Publication Data

US 2014/0290944 A1 Oct. 2, 2014

(51) Int. Cl.

| | |
|---|---|
| ***E21B 23/06*** | (2006.01) |
| ***E21B 33/124*** | (2006.01) |
| ***E21B 33/126*** | (2006.01) |
| ***E21B 43/14*** | (2006.01) |
| ***E21B 43/26*** | (2006.01) |

(52) U.S. Cl.

CPC ..... *E21B 33/124* (2013.01); *E21B 33/126* (2013.01); *E21B 43/14* (2013.01); *E21B 43/26* (2013.01)

(58) Field of Classification Search

CPC ..... E21B 34/14; E21B 43/14; E21B 43/26; E21B 33/124; E21B 2034/007; E21B 33/12; E21B 33/126; E21B 33/16; E21B 33/13; E21B 34/06

See application file for complete search history.

(56) References Cited

U.S. PATENT DOCUMENTS

| | | | | |
|---|---|---|---|---|
| 3,948,322 | A * | 4/1976 | Baker | E21B 33/127 166/154 |
| 5,117,910 | A * | 6/1992 | Brandell | E21B 33/126 166/154 |
| 5,180,016 | A * | 1/1993 | Ross | E21B 23/04 166/194 |
| 7,387,165 | B2 * | 6/2008 | Lopez de Cardenas | E21B 34/06 166/313 |
| 7,584,798 | B2 * | 9/2009 | Dallas | E21B 33/068 166/383 |
| 8,291,980 | B2 * | 10/2012 | Fay | E21B 34/14 166/313 |
| 8,794,331 | B2 * | 8/2014 | Getzlaf | E21B 23/02 166/319 |
| 9,140,097 | B2 * | 9/2015 | Themig | E21B 34/12 |
| 2003/0127227 | A1 * | 7/2003 | Fehr | E21B 33/124 166/306 |
| 2004/0084187 | A1 * | 5/2004 | Costley | E21B 43/26 166/312 |
| 2004/0118564 | A1 * | 6/2004 | Themig | E21B 34/14 166/305.1 |
| 2005/0236154 | A1 * | 10/2005 | Tudor | E21B 33/124 166/308.1 |
| 2007/0295508 | A1 * | 12/2007 | Collins | E21B 43/26 166/308.1 |
| 2008/0264636 | A1 * | 10/2008 | Stromquist | E21B 33/138 166/281 |
| 2013/0043030 | A1 * | 2/2013 | Snider | E21B 43/26 166/308.1 |
| 2013/0199790 | A1 * | 8/2013 | Themig | E21B 23/14 166/305.1 |
| 2013/0312963 | A1 * | 11/2013 | Larsen | E21B 33/13 166/285 |
| 2014/0290944 | A1 * | 10/2014 | Kristoffer | E21B 33/124 166/281 |
| 2015/0047828 | A1 * | 2/2015 | Sherman | E21B 34/063 166/202 |
| 2015/0060076 | A1 * | 3/2015 | Campbell | E21B 34/14 166/308.1 |

FOREIGN PATENT DOCUMENTS

| | | | | |
|---|---|---|---|---|
| CN | 2693944 Y | * | 4/2005 | |
| GB | 2382364 A | * | 5/2003 | E21B 33/126 |

* cited by examiner

*Primary Examiner* — Daniel P Stephenson

(74) *Attorney, Agent, or Firm* — The Kubiak Law Firm, PLLC

(57) ABSTRACT

Zone isolation is a leading concern for operators that wish to fluidly treat a well. Typically in an open hole packers hydraulically actuated solid body packers have been are deployed at particular intervals along the wellbore to provide zonal isolation of various formations or portions of a formation. By isolating the various zones valves may be selectively opened or closed to treat a particular zone independently of the remainder of the well. In an improvement over the past procedures a cup style packer that is particularly useful in open hole may now be used.

36 Claims, 4 Drawing Sheets

ZONAL ISOLATION UTILIZING CUP PACKERS

PRIORITY CLAIM

This application claims priority to Norwegian application number 2013 0440 filed on Mar. 27, 2013.

BACKGROUND

Many types of wellbore treatment require the selective communication of fluids from the surface to a particular zone of a well. One type of wellbore treatment, hydraulic fracturing, is a common and well-known enhancement method for stimulating the production of hydrocarbon bearing formations. The process involves injecting fluid down a wellbore at high pressure. The fracturing fluid is typically a mixture of a transport fluid such as water or diesel, various chemicals to treat the well or to enhance the ability of the transport fluid to entrain the proppant, and proppant. The proppant may be made of natural materials or synthetic materials.

Generally the fracturing process includes pumping the fracturing fluid from the surface through a tubular. The tubular has been prepositioned in the wellbore to access the desired hydrocarbon formation. Depending upon the wellbore environment and the requirements of the operators the well may be either cased or uncased. Packers may be deployed to seal the tubular both above and below each formation or formation zone to isolate fluid flow along the tubular and force the fluid either into or out of the desired formation or formation zone while preventing unwanted fluid loss. Pressure may then be provided from the surface to the desired hydrocarbon formation in order to open a fissure or crack in the hydrocarbon formation.

In the past many types of packers have been used for zonal isolation in a wellbore such as inflatable packers, swell packers, and solid body packers. Each type of packer has its limitations.

SUMMARY

A method has been invented which provides for selective communication to a wellbore for fluid treatment while overcoming the limitations of previous zone isolation methods. In one embodiment of the invention the method provides for selective injection of treatment fluids wherein fluid is injected into selected intervals of the wellbore, while other intervals are closed. In another aspect, the method provides for running in a fluid treatment string, the fluid treatment string having ports substantially closed against the passage of fluid, but when opened permit fluid flow into or out of the wellbore. The methods of the present invention can be used in various borehole conditions including open holes, cased holes, vertical holes, or deviated holes.

In one embodiment for fluid treatment of a borehole, the apparatus comprising a tubing string having a long axis, a first port opened through the wall of the tubing string, a second port opened through the wall of the tubing string, the second port offset from the first port along the long axis of the tubing string, a first packer operable to seal about the tubing string and mounted on the tubing string to act in a position offset from the first port along the long axis of the tubing string, a second packer operable to seal about the tubing string and mounted on the tubing string to act in a position between the first port and the second port along the long axis of the tubing string; a third packer operable to seal about the tubing string and mounted on the tubing string to act in a position offset from the second port along the long axis of the tubing string and on a side of the second port opposite the second packer; a first sleeve positioned relative to the first port, the first sleeve being moveable relative to the first port between a closed port position and a position permitting fluid flow through the first port from the tubing string inner bore and a second sleeve being moveable relative to the second port between a closed port position and a position permitting fluid flow through the second port from the tubing string inner bore; and a sleeve shifting means for moving the second sleeve from the closed port position to the position permitting fluid flow, the means for moving the second sleeve selected to create a seal in the tubing string against fluid flow past the second sleeve through the tubing string inner bore.

In one embodiment, a method for treating a well, includes running a tubing string into an uncased, non-vertical section of a wellbore, the tubing string. Where the tubing string has at least a first port and a second port. The first port and the second port are longitudinally separated along the tubing string. The tubing string has at least a first sliding sleeve and a second sliding sleeve and the first sliding sleeve has a seat with a first diameter, the first sliding sleeve positioned relative to the first port and moveable relative to the first port between (i) a closed port position wherein a fluid can pass the seat and flow downhole of the first sliding sleeve and (ii) an open port position permitting fluid flow through the first port from the tubing string and sealing against fluid flow past the seat and downhole of the first sliding sleeve. Additionally, the second sliding sleeve has a seat with a second diameter smaller than the first diameter, the second sliding sleeve positioned relative to the second port and moveable relative to the second port between (i) a closed port position wherein the fluid can pass the seat and flow downhole of the second sliding sleeve and (ii) an open port position permitting fluid flow through the second port from the tubing string inner bore and sealing against fluid flow past the seat and downhole of the second sliding sleeve. At least one cup packer is mounted on the tubing string between the first port and the second port and the tubing string is run into the wellbore with the at least one cup packer in an unset position such that an annulus between the tubing string and a well bore wall is open. The cup packer is expanded radially outward to seal against the wellbore wall in the uncased, non-vertical section of the wellbore, and create a first annular wellbore segment below the cup packer adjacent to the first port and a second annular wellbore segment above the cup packer adjacent to the second port. A ball is conveyed through the tubing string to pass through the first sliding sleeve to land in and seal against the seat of the second sliding sleeve moving the second sliding sleeve to the open port position permitting fluid flow through the second port. Fluid may be pumped through the second port and into the second annular wellbore segment. In some cases the fluid is a hydraulic fracturing fluid. The tubing string is typically run into the wellbore with the first and second sliding sleeves each in the closed port position. The expanding radially outward typically includes hydraulically setting the cup packer, in some instances by hydraulically driving a compressing piston. The second sliding sleeve is moved without tripping in a string or wire line. The method may proceed without setting any slips on the cup packer. In certain instances the method proceeds without first perforating the wellbore wall of the uncased, non-vertical section of the wellbore. In some instances a second ball may be conveyed through the tubing string by fluid pressure or by gravity to land in and seal against the seat of the first sliding sleeve to move the first sliding sleeve to the open port position permitting fluid flow through the first port. Once the first sliding sleeve is open fracturing fluid may be pumped through the first port and against the wellbore wall in the open hole to fracture the formation, wherein the fracturing fluid is isolated to the first annular segment and the second annular segment. The first sliding sleeve it typically after the second sliding sleeve without tripping in a string or wire line to move the first sliding sleeve. The tubing string is typically supported by a cemented casing or from the surface. After pumping, the method further comprises maintaining the second sliding sleeve in the open port position permitting fluid flow to the surface from the second annular wellbore segment through the tubing string.

In another embodiment of a method for treating a well a tubing string is run into an uncased, non-vertical section of a wellbore. The tubing string may have at least a first port and a second port and the first port and the second port are longitudinally separated along the tubing string. The tubing string may have at least a first sliding sleeve and a second sliding sleeve where the first sliding sleeve has a seat with a first diameter and the first sliding sleeve may be positioned relative to the first port and moveable relative to the first port between (i) a closed port position wherein a fluid can pass the seat and flow downhole of the first sliding sleeve and (ii) an open port position permitting fluid flow through the first port from the tubing string and sealing against fluid flow past the seat and downhole of the first sliding sleeve. The second sliding sleeve may have a seat with a second diameter smaller than the first diameter and the second sliding sleeve may be positioned relative to the second port and moveable relative to the second port between (i) a closed port position wherein the fluid can pass the seat and flow downhole of the second sliding sleeve and (ii) an open port position permitting fluid flow through the second port from the tubing string inner bore and sealing against fluid flow past the seat and downhole of the second sliding sleeve. The tubing string typically has at least a first cup packer mounted on the tubing string uphole from the first port, a second cup packer mounted on the tubing string between the first port and the second port, and a third cup packer mounted on the tubing string downhole from the second port. When the tubing string is run into the wellbore with the first, second, and third cup packers are each in an unset position such that an annulus between the tubing string and the well bore wall is open. Typically the cup packers are expanded radially outwards to seal against a wellbore wall in the uncased, non-vertical section of the wellbore, and create a first annular wellbore segment below the cup packer adjacent to the first port and a second annular wellbore segment above the cup packer adjacent to the second port. A ball may be conveyed through the tubing string to pass through the first sliding sleeve to land in and seal against the seat of the second sliding sleeve moving the second sliding sleeve to the open port position permitting fluid flow through the second port. Fluid may then be pumped through the second port and into the second annular wellbore segment. The fluid is a hydraulic fracturing fluid. When the tubing string is run into the wellbore the first and second sliding sleeves are each in the closed port position. Hydraulically setting the first, second, and third cup packers includes expanding them radially outwards and may include hydraulically driving a compressing piston. Typically the second sliding sleeve is moved without tripping in a string or wire line. The method may proceed without setting any slips on the first, second, or third cup packers and without first perforating the wellbore wall of the uncased, non-vertical section of the wellbore. A second ball may be conveyed through the tubing string to land in and seal against the seat of the first sliding sleeve to move the first sliding sleeve to the open port position permitting fluid flow through the first port; and pumping fracturing fluid through the first port and against the wellbore wall in the open hole to fracture the formation, wherein the fracturing fluid is isolated to the first annular segment and the second annular segment. Typically the first sliding sleeve is moved after the second sliding sleeve without tripping in a string or wire line to move the first sliding sleeve. The tubing string may be supported by a cemented casing or from the surface. Typically after pumping the second sliding sleeve is kept in the open port position permitting fluid flow to the surface from the second annular wellbore segment through the tubing string.

In another embodiment of a method for treating a well a tubing string is run into a cased, non-vertical section of a wellbore. The tubing string may have at least a first port and a second port and the first port and the second port are longitudinally separated along the tubing string. The tubing string may have at least a first sliding sleeve and a second sliding sleeve where the first sliding sleeve has a seat with a first diameter and the first sliding sleeve may be positioned relative to the first port and moveable relative to the first port between (i) a closed port position wherein a fluid can pass the seat and flow downhole of the first sliding sleeve and (ii) an open port position permitting fluid flow through the first port from the tubing string and sealing against fluid flow past the seat and downhole of the first sliding sleeve. The second sliding sleeve may have a seat with a second diameter smaller than the first diameter and the second sliding sleeve may be positioned relative to the second port and moveable relative to the second port between (i) a closed port position wherein the fluid can pass the seat and flow downhole of the second sliding sleeve and (ii) an open port position permitting fluid flow through the second port from the tubing string inner bore and sealing against fluid flow past the seat and downhole of the second sliding sleeve. The tubing string typically has at least a first cup packer mounted on the tubing string uphole from the first port, a second cup packer mounted on the tubing string between the first port and the second port, and a third cup packer mounted on the tubing string downhole from the second port. When the tubing string is run into the wellbore the first, second, and third cup packers are each in an unset position such that an annulus between the tubing string and the well bore wall is open. It may be preferable to position at least the first and second ports approximately adjacent to at least two perforations in the casing. Typically the cup packers are expanded radially outwards to seal against a wellbore wall in a cased, non-vertical section of the wellbore, and create a first annular wellbore segment below the cup packer adjacent to the first port and a second annular wellbore segment above the cup packer adjacent to the second port. A ball may be conveyed through the tubing string to pass through the first sliding sleeve to land in and seal against the seat of the second sliding sleeve moving the second sliding sleeve to the open port position permitting fluid flow through the second port. Fluid may then be pumped through the second port and into the second annular wellbore segment. The fluid is a hydraulic fracturing fluid. When the tubing string is run into the wellbore the first and second sliding sleeves are each in the closed port position. Hydraulically setting the first, second, and third cup packers includes expanding them radially outwards and may include hydraulically driving a compressing piston. Typically the second sliding sleeve is moved without tripping in a string or wire line. The method may proceed without setting any slips on the first, second, or third cup packers. A second ball may be conveyed through the tubing string to land in and seal against the seat of the first sliding sleeve to move the first sliding sleeve to the open port position permitting fluid flow through the first port; and pumping fracturing fluid through the first port, through the perforations in the casing, and against the wellbore wall in the open hole to fracture the formation, wherein the fracturing fluid is isolated to the first annular segment and the second annular segment. Typically the first sliding sleeve is moved after the second sliding sleeve without tripping in a string or wire line to move the first sliding sleeve. Typically after pumping the second sliding sleeve is kept in the open port position permitting fluid flow to the surface from the second annular wellbore segment through the tubing string.

DETAILED DESCRIPTION OF THE PRESENT INVENTION

Figure 1:
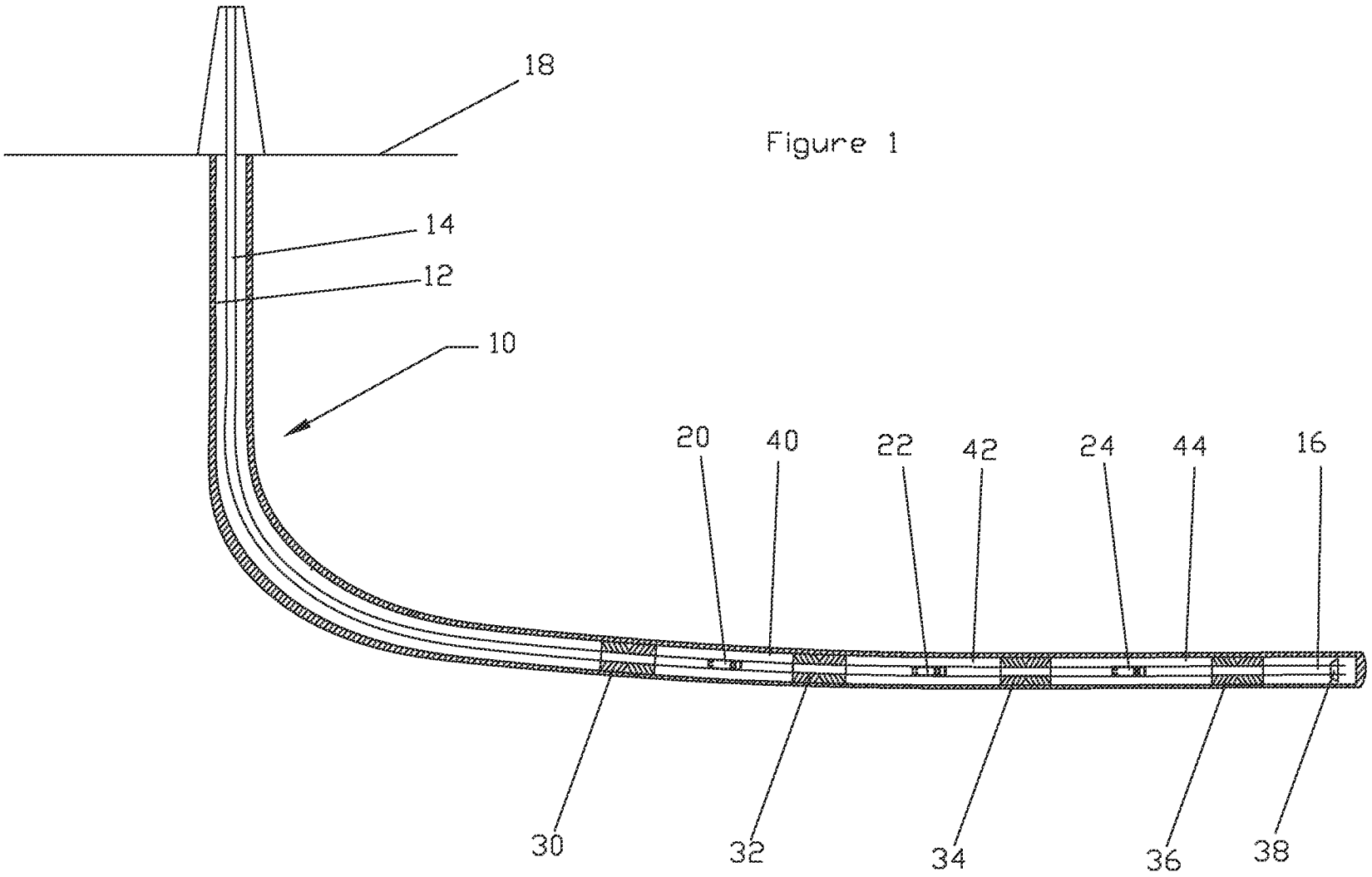
FIG. 1 depicts a wellbore fluid treatment assembly in an open hole.

Referring to FIG. 1, a wellbore fluid treatment assembly is shown that may be used for fluid treatment of formation 10 through wellbore 12. The treating assembly includes tubing string 14 having a lower end 16 and an upper end extending to surface 18. Tubing string 14 includes spaced apart ports 20, 22, and 24 through the tubing string 14 wall to permit access between the tubing string inner bore 18 and the wellbore 12.

A cup packer 30 is mounted between the uppermost port 20 and the surface 18, cup packer 32 is mounted below port 20 but above port 22 to form isolated zone 40. Cup packer 34 is mounted below port 22 but above port 24 to form isolated zone 42. Cup packer 36 is mounted below port 24 to form isolated zone 44. In certain instances the lowest cup packer, cup packer 36, may be omitted. Each cup packer 30, 32, 34, and 36 is circumferentially mounted on the tubing string 14 to seal the annulus between the tubing string 14 and the wellbore wall 12, when the treating assembly is secured in the wellbore by any means known such as hanging the tubing string 14 from casing that may be cemented in the wellbore 12 or supporting the tubing string 14 from the surface 18. Each cup packer 30, 32, 34, and 36 divides the wellbore 12 into isolated zones 40, 42, and 44 to allow individual isolated zones to be treated individually while preventing wellbore treatment fluid from passing through the annulus to adjacent isolated zones. As will be appreciated the cup packers can be spaced in any way relative to the ports to achieve the desired interval length or number of ports per isolated zone.

Figure 2:
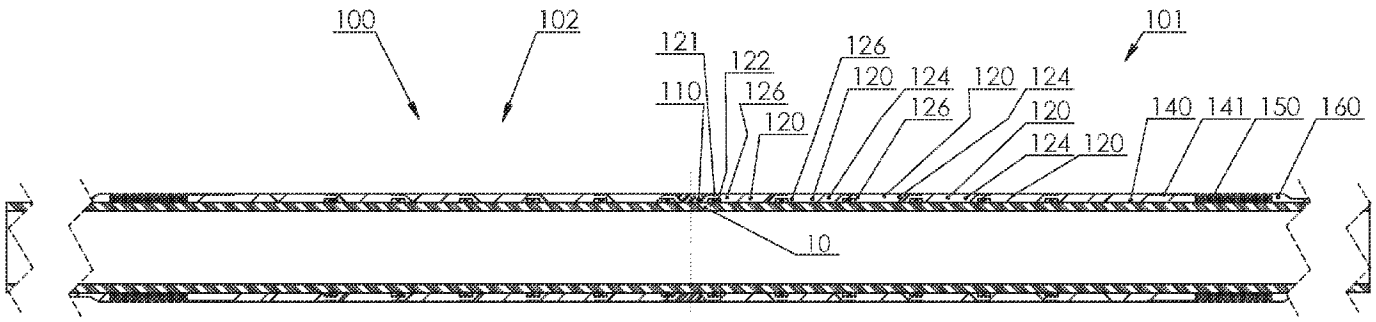
FIG. 2 depicts an unset cup packer.

FIG. 2 depicts an unset cup style packer cup used in one embodiment. A packer element 100 may be arranged around a mandrel 10. The packer element 100 is shown in the condition it is typically in when run into a well, a non-expanded configuration. The mandrel 10 may be a tubular or it could be solid.

The cup packer element 100 includes a series of segments 120 sequentially positioned along the exterior of the mandrel 10. Typically the annular segments 120 are arranged around center part 110, in such a manner that an unsecured end 124 of each segment 120 faces away from center part 110.

Figure 4:
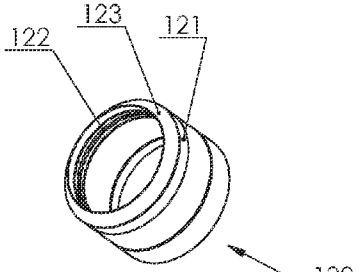
FIG. 4 depicts a view of a segment from its secured end.
Figure 3:
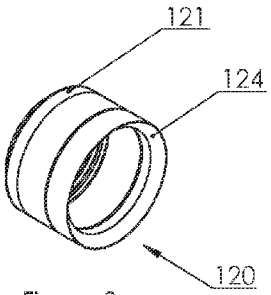
FIG. 3 depicts a view of a segment from its unsecured end.

Reference is now made to the right hand side one half 101 of the cup packer element 100 appearing to the right in FIG. 2, and to FIGS. 3 and 4, showing a segment 120. Each segment 120 is provided with an inner seal 122 for sealing against the outer surface of mandrel 10. Seal 122 may be two O-rings, but it should be understood that any seal which is able to resist a possible differential pressure across segment 120 and which is able to slide axially along the outer surface of mandrel 10 could be used. A clamping ring 121 prevents the inner or radially secured end 126 of each segment 120 from moving radially and also forces the seal 122 against mandrel 10. The clamping ring 121 may be made of a suitable material, such as carbon fiber or steel, for example.

An end piece 140 may include a supporting ring 141, springs 150, and an actuating piston 160 arranged around mandrel 10 and longitudinally beyond the end of segments 120. Each of the segments 120, supporting ring 141, springs 150, and an actuating piston 160 is longitudinally slidably supported along the outer surface of mandrel 10.

Figure 5:
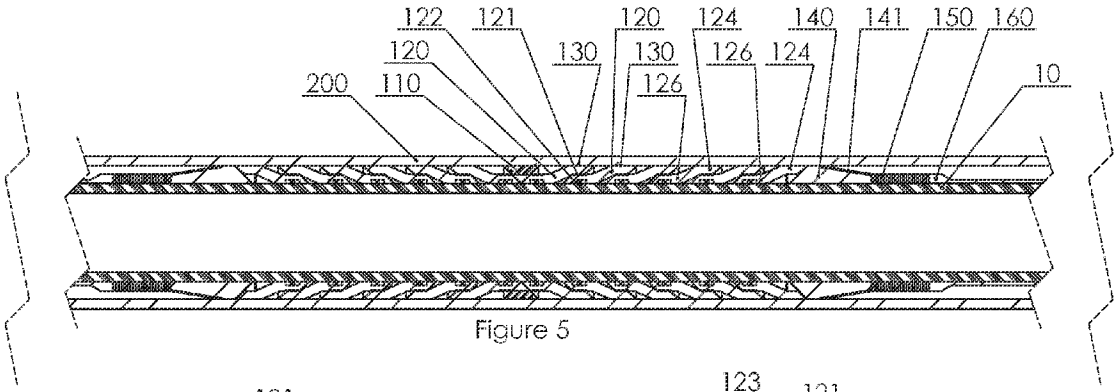
FIG. 5 depicts a set cup packer.

As depicted in FIG. 5 when the actuating piston 160 moves longitudinally towards center part 110, the unsecured end 124 of each segment 120 is forced radially outward so that each half of the cup packer forms a one way seal against a wellbore wall 200. The two halves 101 and the left hand side one half 102 together seal the annular region between the mandrel 10 and the wellbore wall 200. The wellbore wall 200 may be either cased or uncased. It is understood that center element 110 is not important in achieving this effect, and that it is sufficient to have one movable actuating piston 160 at a single end of the cup packer element 100 and a stopper at the other end thereof.

End piece 140 has a support ring 141 to prevent the end piece 140 from extruding into the annulus between the wellbore wall and mandrel 10 when the element 100 is exposed to the well pressures and temperatures. Support ring 141 does not in itself effect any seal against the wellbore fluid.

Figure 6:
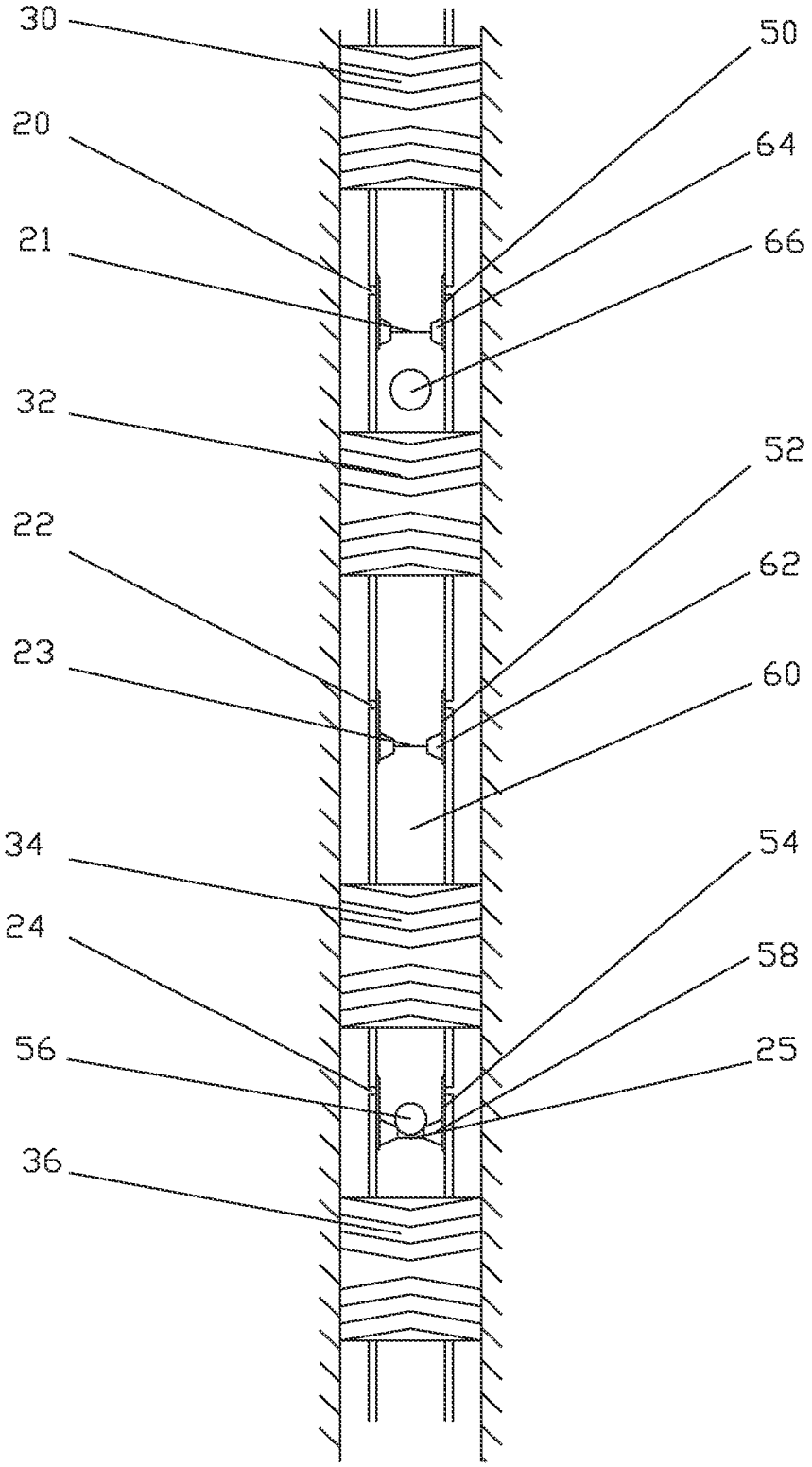
FIG. 6 depicts a wellbore fluid treatment assembly in an open hole with sequentially settable seats.

When the actuating piston 160 is locked in the position shown in FIG. 6 the spring 150 is compressed and acts on end piece 140 with a longitudinally directed force. In the event that an elastomer is used in segments 120 and the properties of the elastomer change due to pressure, temperature, or the inherent aging of the elastomer when exposed to the well environment, then the springs 150 will continue to further compress cup packer element 100 even if the actuating piston 160 no longer supplies longitudinal force or otherwise does not move.

Actuating piston 160 may be of any type known in the art, such as a hydraulic piston or a piston which is moved axially when a leading screw is rotated inside an internally threaded nut, for example. In many applications, however, the cup packer is to be permanently installed in the wellbore, e.g. between two production zones, so that a simple mechanism is preferred to a more complicated and expensive one. One example of such an embodiment is a hydraulically actuated piston having a one-way mechanism, e.g. a ratchet mechanism, to prevent the piston from moving backwards.

FIG. 5 depicts the cup packer after the actuating piston 160 has been moved towards center part 110. The segments 120 are longitudinally compressed and the unsecured ends 124 of each segment 120 has moved radially outwards and over the secured ends 126 of the adjacent segments 120. The unsecured ends 124 of each segment 120 have been moved radially outwards to seal against the wellbore wall 200 by a force of sufficient magnitude to prevent fluid from passing through in the annulus between mandrel 10 and wellbore wall 200.

In the radially expanded configuration, the group of segments 120 resembles a stack of cups with their openings facing actuating piston 160 such that if fluid pressure is applied to the stacked and radially expanded segments 120 from the direction of the actuating piston 160 towards center part 110, then the applied pressure will assist in pressing the unsecured ends 124 of segments 120 tighter against the wellbore wall 200.

Typically the cup packer will have a first group of segments 120 on the right half of the cup packer and a second group of segments on the left side of the cup packer. The first group of segments 120 such as the segments 120 on the right half of the cup packer will face to the right with the corresponding second group of segments 120 in which the segments 120 are faced in the opposite direction or as shown to the left. The first group of segments 120 on the right side of the cup packer, with their cups opening to the right, seal particularly well against pressure from the right while the second group of segments 120 on the left side of the cup packer with their cups facing to the left seal particularly well against a pressure differential from the left towards the right. Cup packer element 100, comprising both the first and second group of annular segments 120, provides a seal regardless of the direction of the differential pressure across cup packer 100.

A cup packer including a series of independent segments 120 in many instances seals better against rough surfaces than a continuous sleeve. When an elastic sleeve is positioned above a depression, the material of the elastic sleeve on both sides of the depression will try to pull the sleeve out from the depression, preventing elastic material from entering into the depression to seal efficiently. The segments 120 are not secured to one another, consequently neighboring segments will not act to pull material out from the depression. Therefore, a single segment 120 will be more easily able to enter into a depression in the wellbore wall than will a continuous sleeve, so that a series of independent segments will achieve a better seal against the depression as compared with a continuous sleeve. Similarly, a series of independent segments 120 will be more easily able to surround an elevation in the wellbore wall as the segments are slightly movable relative to each other. The result is that, with the conditions being otherwise identical, a series of segments 120 provides a better seal against an uneven wellbore wall as compared with a continuous packer sleeve. Segmented cup packer elements as described herein, therefore, are well suited for use in open wellbores although segmented cup packer elements may be utilized in any wellbore environment, including cased holes.

In one embodiment, the segments 120 vary in composition such that those segments 120 closest to center part 110 use an elastomer that is more easily deformed than the elastomer used in the segments 120 that are at a greater longitudinal distance from center part 110. Such an arrangement is to provide that the segments closest to the center of cup packer element 100 will seal against the wellbore wall 200 before sealing is achieved by the more distal segments, so that the outermost segments will not make sealing contact first and thereby create unnecessarily high friction against the wellbore wall when the segments are moved towards each other while the plug is being set. While providing for the inner segments to move radially outward prior to the segments further from the center may be achieved by utilizing different material in the segments such an effect may also be provided by allowing the segments 120 closest to center part 110 to have thinner walls than the segments further away from center part 110 or by utilizing any other manner known to a person skilled in the art.

Additionally, the use of stiffer segments 120 at distance from center part 110 may also prevent extrusion of the softer segments 120 along the longitudinal axis of the plug. Hence, both relatively soft segments which easily conform to depressions and elevations in the wellbore wall as well as stiffer segments able to resist higher pressures and temperatures can be used in same cup packer element.

Alternatively, segments 120 may be made of a material, such as lead, which deforms plastically when the cup packer element 100 is activated. Such an embodiment may be suited for plugs to be installed permanently in a well, or for cases in which the pressures and temperatures make it difficult to achieve an adequate seal using an elastomer.

FIGS. 3 and 4 show an embodiment of an annular segment 120 made of an elastomeric material, typically a synthetic rubber compound. The segment 120 includes an inner end, typically the secured end, having an outer frusto-conical sliding surface 123, and an outer end, typically the non-secured end, having an inner frusto-conical sliding surface 124. The sliding surfaces 123 and 124 have about same slope, allowing the outer end of a segment to easily slide over the inner end of a similar segment when the cup packer 100 shown in FIGS. 3 and 6 is activated.

The inner end is provided with an inner seal 122, shown as two longitudinally spaced apart O-rings. Any other known seal capable of sliding axially on an outer cylindrical surface could be used.

A clamping ring 121 is positioned around the inner end, the secured end, of the elastic segment 120. The function of the clamping ring 121 is to squeeze the inner end of the segment 120 to bear against the a cylindrical surface, Mandrel 10 in FIGS. 3 and 6, and the ring may advantageously be made of carbon fiber, steel, or any other suitable material so as to not expand excessively in a radial direction when the segment 120 is subject to pressure.

A single half of a cup packer 100 that includes a series of segments 120 provides a sequence of sealing surfaces against mandrel 10 at each seal 122 as well as against the wellbore wall 200 at abutment faces 130, and therefore will be able to resist many small differential pressures, or a large total differential pressure from one side, while the other, oppositely facing half of the cup packer 100 is able resist a corresponding differential pressure acting in the other direction along the length of the cup packer. Hence, cup packer element 100 provides an improved seal within a wellbore.

FIG. 6 depicts a wellbore fluid treatment assembly located in a wellbore. Sliding sleeves 50, 52, and 54 are disposed in the tubing string to control the opening of the ports 20, 22, and 24. In this embodiment, a sliding sleeve 50, 52, and 54 is mounted over each port 20, 22, and 24 respectively to close them against fluid flow therethrough. However, each sliding sleeve 50, 52, and 54 may be moved away from their positions covering the ports 20, 22, and 24 to selectively open each ports and allow fluid flow therethrough.

The wellbore treatment assembly is run in and positioned downhole with the sliding sleeves 50, 52, and 54 each in their closed position, blocking ports 50, 52, and 54. Preferably, the sleeves for each isolated interval between adjacent packers are opened individually to permit fluid flow to one isolated wellbore segment at a time.

Preferably, the sliding sleeves 50, 52, and 54 are each moveable remotely from their closed port position to their position permitting through-port fluid flow. In one embodiment, the sliding sleeves are each actuated by a device, such as a ball 56, a plug, or a dart, which can be conveyed by gravity or fluid flow through the tubing string. The ball 56 seats on seat 58 blocking fluid flow past sleeve 54. When pressure is applied through the tubing string inner bore 60 from surface, ball 56 and seat 58 create a pressure differential above and below the sleeve 54 which drives the sleeve 54 toward the lower pressure side, in this case down the wellbore.

In FIG. 6 the inner surface of each sleeve 50, 52, and 54 that is open to the inner bore 60 of the tubing string defines a seat 58, 62, and 64 respectively onto which an associated ball when launched from surface, can land and seal thereagainst. When the ball seals against its associated sleeve seat and pressure is applied or increased from surface, a pressure differential is set up which causes the sliding sleeve on which the ball has landed to slide to an port-open position. When the ports of the particular ported interval are opened, fluid can flow therethrough to the annulus between the tubing string and the wellbore and thereafter into contact with formation 10.

Each of the plurality of sliding sleeves has a different diameter seat and therefore each accept different sized balls. In particular, the lowest sliding sleeve 54 has the smallest diameter D1 seat and accepts the smallest sized ball 56. Each sleeve that is progressively closer to the surface has a larger seat. For example the sleeve 50 includes a seat 64 having a diameter D3, sleeve 52 includes a seat 62 having a diameter D2, which is less than D3 and sleeve 54 includes a seat 58 having a diameter D1, which is less than D2. Such an arrangement allows the operator to open the lowest sleeve first by first launching the smallest ball 56. The ball 56, having a small diameter may pass through each of the larger diameter seats closer to surface without actuating them but that will land in and seal against seat 58 of sleeve 54. Additionally a higher sleeve such sleeve 52 can be actuated to move away from port 22 by launching a ball 66 that is sized to pass through all of the seats closer to surface, such as seat 64, but which will land in and seal against seat 62.

Lower end 16 of the tubing string can be open, closed or fitted in various ways, depending on the desired operational characteristics of the tubing string. FIG. 1 depicts a pump out plug assembly 38 that acts to close off end 16 while the tubing string is being run in to prevent fluid in the wellbore from entering the tubing string from the lower end. Typically the plug assembly 38 may be opened to allow the lower most sleeve 36 to be opened Typically the plug assembly may be opened by applying fluid pressure, for example at a pressure of about 3000 psi.

FIG. 1 depicts three isolated segments having ports and sliding sleeves any number of isolated segments having ports and sliding sleeves could be used. It is also to be understood that any number of ports and sliding sleeves can be used in each isolated segment. Additionally, other subassemblies typically used in a wellbore may be run in with the wellbore treatment assembly.

In use, the wellbore fluid treatment assembly, as described with respect to FIGS. 1 and 6, can be used in the fluid treatment of a wellbore. In order to selectively treat formation 10 through wellbore 12, the wellbore fluid treatment assembly is run into the wellbore 12 and the cup packers 30, 32, 34, and 36 are set to seal the annulus at each location creating a plurality of isolated annular zones. If desired fluids may be pumped down the tubing string and out of the bottom of the tubing assembly through end 16 or plug 38 and in to the zone formed below the lowest cup packer 36. To fluidly treat the remaining higher zones, a ball 56 or another sealing plug is launched from surface and conveyed by gravity or fluid pressure to seal against seat 58 of the lower most sliding sleeve 54 sealing off the tubing string below sliding sleeve 54 and opening the sliding sleeve 54 to allow fluid to flow through port 24 and into the isolated zone between cup packer 36 and cup packer 34. The ball or other sealing device 56 is sized to pass through all of the seats, such as seats 62 and 64. When the fluid treatment of the isolated zone between cup packer 34 and 36 is completed, a second ball 66 may be launched. The second ball 66 is sized to pass through all of the seats closer to the surface than seat 62, such as seat 64, and to seat in seat 62 thereby moving sliding sleeve 52 opening ports 22 thereby allowing fluid flow through port 22 and into the isolated zone between packers 32 and 34. Launching progressively larger balls or plugs is repeated until all of the zones are treated. The balls can be launched without stopping the flow of treating fluids. After treatment, fluids can be shut in or flowed back immediately. Once fluid pressure is reduced from surface, any balls seated in sleeve seats can be unseated by pressure from below to permit fluid flow upwardly therethrough.

The apparatus is particularly useful for stimulation of a formation including hydraulic fracturing using stimulation fluids, such as acid, gelled acid, gelled water, gelled oil, $CO_2$, nitrogen, or proppant laden fluids.

The balls, such as 24 and 66, may be a ball, dart, or any other object that may form a seal against a seat and may be formed of ceramics, steel, plastics or other durable materials.

Figure 7:
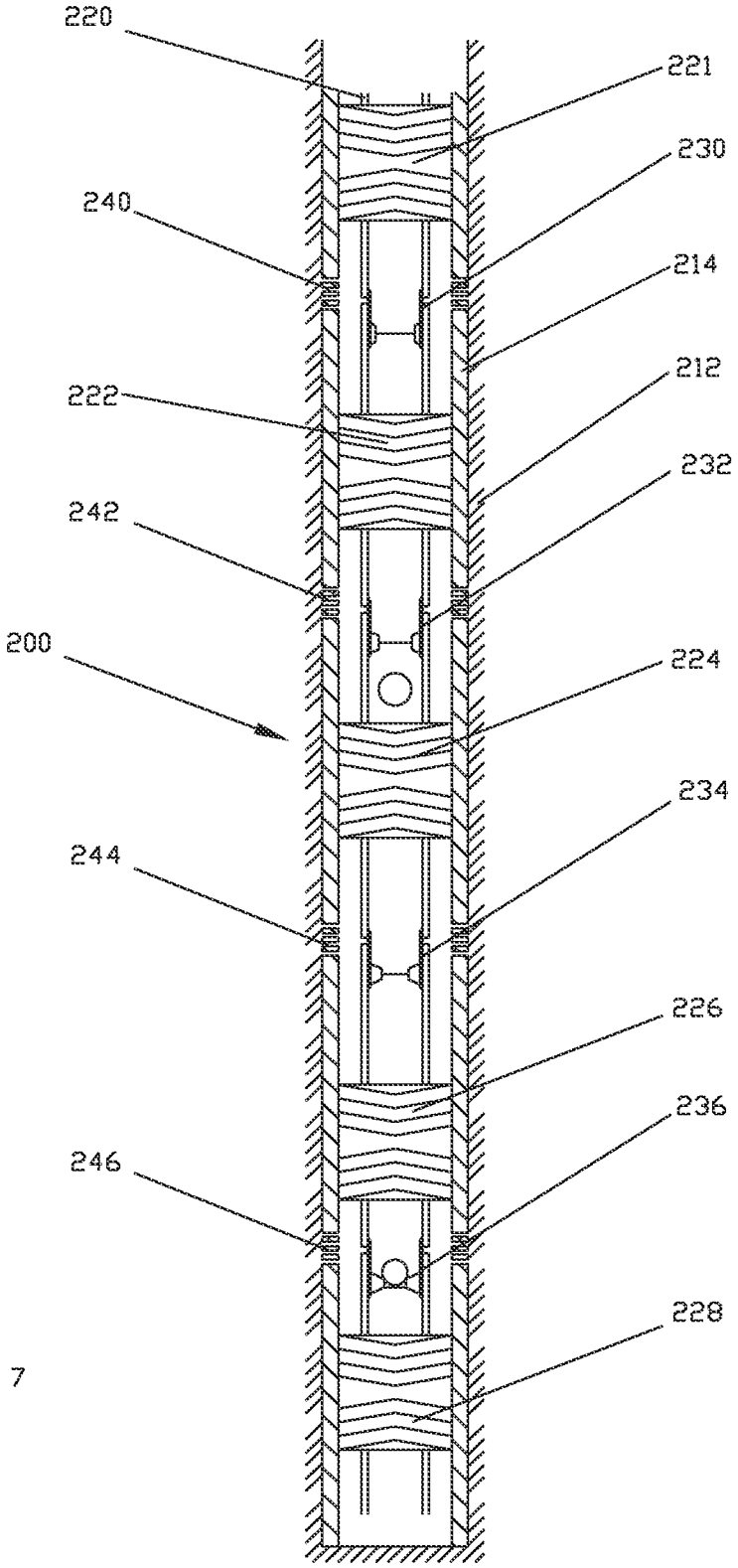
FIG. 7 depicts a wellbore fluid treatment assembly in a cased hole.

As depicted in FIG. 7, multiple intervals in a wellbore 212 lined with casing 214 can be treated with fluid using an assembly and method similar to that depicted in FIGS. 1 and 6. In a cased wellbore 212, perforations 240, 242, 244, and 246 are formed thought the casing 214 to provide access to the formation 200. The fluid treatment assembly includes a tubing string 220 with cup packers 222, 224, 226, and 228, suitable for use in cased holes, positioned at preselected locations in the wellbore 212. Between the packers 222, 224, 226, and 228 are ports 230, 232, 234, and 236. Flow through each port 230, 232, 234, and 236 is controlled by a ball actuated sliding sleeve. Each sleeve has a seat sized to permit staged opening of the sleeves.

Similarly to the process described in reference to FIGS. 1 and 6, in use, the tubing string 220 is run into the wellbore 212 and the cup packers 222, 224, 226, and 228 are placed between the perforations 240, 242, 244, and 246. The cup packers 222, 224, 226, and 228 are then set by mechanical or pressure actuation. Once the cup packers 222, 224, 226, and 228 are set, stimulation fluids may then be pumped down the tubing string 220. A ball or plug is then dropped or pumped to land in a particular seat in an appropriately sized in a particular sliding sleeve thereby shutting off low past the seat and sliding sleeve and allowing fluid to be forced into the adjacent isolated zone between two cup packers on either side of the perforations and port.

The process is continued until all desired isolated zones of the wellbore are stimulated or treated. The treating fluids may be either shut in or flowed back. The assembly may be removed or fluids may be produced through it.

While the embodiments are described with reference to various implementations and exploitations, it will be understood that these embodiments are illustrative and that the scope of the inventive subject matter is not limited to them. Many variations, modifications, additions and improvements are possible.

Bottom, lower, or downward denotes the end of the well or device away from the surface, including movement away from the surface. Top, upwards, raised, or higher denotes the end of the well or the device towards the surface, including movement towards the surface. While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A method for treating a well comprising:

running a tubing string into an uncased, non-vertical section of a wellbore, the tubing string comprising:

at least a first port and a second port wherein the first port and the second port are longitudinally separated along the tubing string, at least a first sliding sleeve and a second sliding sleeve wherein the first sliding sleeve has a seat with a first diameter, the first sliding sleeve positioned relative to the first port and moveable relative to the first port between (i) a closed port position wherein a fluid can pass the seat and flow downhole of the first sliding sleeve and (ii) an open port position permitting fluid flow through the first port from the tubing string and sealing against fluid flow past the seat and downhole of the first sliding sleeve, further wherein the second sliding sleeve has a seat with a second diameter smaller than the first diameter, the second sliding sleeve positioned relative to the second port and moveable relative to the second port between (i) a closed port position wherein the fluid can pass the seat and flow downhole of the second sliding sleeve and (ii) an open port position permitting fluid flow through the second port from the tubing string inner bore and sealing against fluid flow past the seat and downhole of the second sliding sleeve, at least one cup packer mounted on the tubing string between the first port and the second port, wherein the at least one cup packer has at least a first set of two directional elements aligned in a first direction and a second set of two directional elements aligned in a second direction;

wherein the at least one cup packer isolates the first port from the second port in both of the first direction and the second direction;

wherein the tubing string is run into the wellbore with the at least one cup packer in an unset position such that an annulus between the tubing string and a well bore wall is open, expanding radially outward the cup packer to seal against the wellbore wall in the uncased, non-vertical section of the wellbore, and create a first annular wellbore segment below the cup packer adjacent to the first port and a second annular wellbore segment above the cup packer adjacent to the second port;

conveying a ball through the tubing string to pass through the first sliding sleeve to land in and seal against the seat of the second sliding sleeve moving the second sliding sleeve to the open port position permitting fluid flow through the second port; and pumping the fluid through the second port and into the second annular wellbore segment.

2. The method for treating a well of claim 1 wherein the fluid is a hydraulic fracturing fluid.

3. The method for treating a well of claim 1 wherein the tubing string is run into the wellbore with the first and second sliding sleeves each in the closed port position.

4. The method for treating a well of claim 1 wherein the expanding radially outward includes hydraulically driving the setting the cup packer.

5. The method of claim 1 wherein the expanding radially outward includes hydraulically driving a compressing piston.

6. The method of claim 1 wherein the second sliding sleeve is moved without tripping in a string or wire line.

7. The method of claim 1 wherein the method proceeds without setting any slips on the cup packer.

8. The method of claim 1 wherein the method proceeds without first perforating the wellbore wall of the uncased, non-vertical section of the wellbore.

9. The method of claim 1 further comprising conveying a second ball through the tubing string to land in and seal against the seat of the first sliding sleeve to move the first sliding sleeve to the open port position permitting fluid flow through the first port; and pumping fracturing fluid through the first port and against the wellbore wall in the open hole to fracture the formation, wherein the fracturing fluid is isolated to the first annular segment and the second annular segment.

10. The method of claim 9 wherein the first sliding sleeve is moved after the second sliding sleeve without tripping in a string or wire line to move the first sliding sleeve.

11. The method of claim 1 wherein the tubing string is supported by a cemented casing.

12. The method of claim 1 wherein the tubing string is supported from the surface.

13. The method of claim 1 wherein after pumping, the method further comprises maintaining the second sliding sleeve in the open port position permitting fluid flow to the surface from the second annular wellbore segment through the tubing string.

14. A method for treating a well comprising:

running a tubing string into an uncased, non-vertical section of a wellbore, the tubing string comprising:

at least a first port and a second port wherein the first port and the second port are longitudinally separated along the tubing string, at least a first sliding sleeve and a second sliding sleeve wherein the first sliding sleeve has a seat with a first diameter, the first sliding sleeve positioned relative to the first port and moveable relative to the first port between (i) a closed port position wherein a fluid can pass the seat and flow downhole of the first sliding sleeve and (ii) an open port position permitting fluid flow through the first port from the tubing string and sealing against fluid flow past the seat and downhole of the first sliding sleeve, further wherein the second sliding sleeve has a seat with a second diameter smaller than the first diameter, the second sliding sleeve positioned relative to the second port and moveable relative to the second port between (i) a closed port position wherein the fluid can pass the seat and flow downhole of the second sliding sleeve and (ii) an open port position permitting fluid flow through the second port from the tubing string inner bore and sealing against fluid flow past the seat and downhole of the second sliding sleeve, a first cup packer mounted on the tubing string uphole from the first port, wherein the first cup packer isolates the first port from an upper portion of the wellbore in both of a first direction and a second direction;

a second cup packer mounted on the tubing string between the first port and the second port, wherein the second cup packer isolates the first port from the second port in both of the first direction and the second direction;

a third cup packer mounted on the tubing string downhole from the second port, wherein the third cup packer isolates the second port from a lower portion of the wellbore in both of the first direction and the second direction;

wherein the tubing string is run into the wellbore with the first, second, and third cup packers each in an unset position such that an annulus between the tubing string and the well bore wall is open, wherein each of the first, second, and third cup packer has at least a first set of two directional elements aligned in the first direction and a second set of two directional elements aligned in the second direction;

wherein the at least one cup packer isolates the first port from the second port in both of the first direction and the second direction;

expanding radially outward each of the first, second, and third cup packers to seal against a wellbore wall in the uncased, non-vertical section of the wellbore, and create a first annular wellbore segment between the first cup packer and the second cup packer adjacent to the first port and a second annular wellbore segment between the third cup packer and the second cup packer adjacent to the second port;

conveying a ball through the tubing string to pass through the first sliding sleeve to land in and seal against the seat of the second sliding sleeve moving the second sliding sleeve to the open port position permitting fluid flow through the second port; and pumping the fluid through the second port and into the second annular wellbore segment.

15. The method for treating a well of claim 14 wherein the fluid is a hydraulic fracturing fluid.

16. The method for treating a well of claim 14 wherein the tubing string is run into the wellbore with the first and second sliding sleeves each in the closed port position.

17. The method for treating a well of claim 14 wherein the expanding radially outward includes hydraulically setting the first, second, and third cup packers.

18. The method of claim 14 wherein the expanding radially outward includes hydraulically driving a compressing piston.

19. The method of claim 14 wherein the second sliding sleeve is moved without tripping in a string or wire line.

20. The method of claim 14 wherein the method proceeds without setting any slips on the first, second, or third cup packers.

21. The method of claim 14 wherein the method proceeds without first perforating the wellbore wall of the uncased, non-vertical section of the wellbore.

22. The method of claim 14 further comprising conveying a second ball through the tubing string to land in and seal against the seat of the first sliding sleeve to move the first sliding sleeve to the open port position permitting fluid flow through the first port; and pumping fracturing fluid through the first port and against the wellbore wall in the open hole to fracture the formation, wherein the fracturing fluid is isolated to the first annular segment and the second annular segment.

23. The method of claim 22 wherein the first sliding sleeve is moved after the second sliding sleeve without tripping in a string or wire line to move the first sliding sleeve.

24. The method of claim 14 wherein the tubing string is supported by a cemented casing.

25. The method of claim 14 wherein the tubing string is supported from the surface.

26. The method of claim 14 wherein after pumping, the method further comprises maintaining the second sliding sleeve in the open port position permitting fluid flow to the surface from the second annular wellbore segment through the tubing string.

27. A method for treating a well comprising:

running a tubing string into a cased, non-vertical section of a wellbore, the tubing string comprising:

at least a first port and a second port wherein the first port and the second port are longitudinally separated along the tubing string, at least a first sliding sleeve and a second sliding sleeve wherein the first sliding sleeve has a seat with a first diameter, the first sliding sleeve positioned relative to the first port and moveable relative to the first port between (i) a closed port position wherein a fluid can pass the seat and flow downhole of the first sliding sleeve and (ii) an open port position permitting fluid flow through the first port from the tubing string and sealing against fluid flow past the seat and downhole of the first sliding sleeve, further wherein the second sliding sleeve has a seat with a second diameter smaller than the first diameter, the second sliding sleeve positioned relative to the second port and moveable relative to the second port between (i) a closed port position wherein the fluid can pass the seat and flow downhole of the second sliding sleeve and (ii) an open port position permitting fluid flow through the second port from the tubing string inner bore and sealing against fluid flow past the seat and downhole of the second sliding sleeve, a first cup packer mounted on the tubing string uphole from the first port, wherein the first cup packer isolates the first port from an upper portion of the wellbore in both of a first direction and a second direction;

a second cup packer mounted on the tubing string between the first port and the second port, wherein the second cup packer isolates the first port from the second port in both of the first direction and the second direction;

a third cup packer mounted on the tubing string downhole from the second port, wherein the third cup packer isolates the second port from a lower portion of the wellbore in both of the first direction and the second direction wherein the tubing string is run into the wellbore with the first, second, and third cup packers each in an unset position such that an annulus between the tubing string and the well bore wall is open, wherein each of the first, second, and third cup packer has at least a first set of two directional elements aligned in the first direction and a second set of two directional elements aligned in the second direction;

positioning the first and second ports approximately adjacent to at least two perforations in the casing expanding radially outward each of the first, second, and third cup packers to seal against a wellbore wall in the uncased, non-vertical section of the wellbore, and create a first annular wellbore segment between the first cup packer and the second cup packer adjacent to the first port and a second annular wellbore segment between the third cup packer and the second cup packer adjacent to the second port;

conveying a ball through the tubing string to pass through the first sliding sleeve to land in and seal against the seat of the second sliding sleeve moving the second sliding sleeve to the open port position permitting fluid flow through the second port; and pumping the fluid through the second port and into the second annular wellbore segment.

28. The method for treating a well of claim 27 wherein the fluid is a hydraulic fracturing fluid.

29. The method for treating a well of claim 27 wherein the tubing string is run into the wellbore with the first and second sliding sleeves each in the closed port position.

30. The method for treating a well of claim 27 wherein the expanding radially outward includes hydraulically setting the first, second, and third cup packers.

31. The method of claim 27 wherein the expanding radially outward includes hydraulically driving a compressing piston.

32. The method of claim 27 wherein the second sliding sleeve is moved without tripping in a string or wire line.

33. The method of claim 27 wherein the method proceeds without setting any slips on the first, second, or third cup packers.

34. The method of claim 27 further comprising conveying a second ball through the tubing string to land in and seal against the seat of the first sliding sleeve to move the first sliding sleeve to the open port position permitting fluid flow through the first port; and pumping fracturing fluid through the first port, through the perforations, and against the wellbore wall to fracture the formation, wherein the fracturing fluid is isolated to the first annular segment and the second annular segment.

35. The method of claim 34 wherein the first sliding sleeve is moved after the second sliding sleeve without tripping in a string or wire line to move the first sliding sleeve.

36. The method of claim 27 wherein after pumping, the method further comprises maintaining the second sliding sleeve in the open port position permitting fluid flow to the surface from the second annular wellbore segment through the tubing string.

* * * * *